US006792124B2

(12) United States Patent
Tilbury et al.

(10) Patent No.: US 6,792,124 B2
(45) **Date of Patent: *Sep. 14, 2004**

(54) GARMENT WITH REMOVABLE ELECTRONIC DEVICES

(75) Inventors: Nancy A. Tilbury, London (GB); Juliette Allen, London (GB); Kyriakos J. Mama, Brighton (GB); Jenni L. Arksey, London (GB); George Marmaropoulos, New York, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/878,988

(22) Filed: Jun. 12, 2001

(65) Prior Publication Data

US 2003/0108217 A1 Jun. 12, 2003

(30) Foreign Application Priority Data

Jun. 12, 2000 (GB) ..... 0014321

(51) Int. Cl.[7] ..... H04R 25/00
(52) U.S. Cl. ..... 381/333; 381/301; 381/388
(58) Field of Search ..... 381/301, 333, 381/334, 388; 2/2.17, 69, 905

(56) References Cited

U.S. PATENT DOCUMENTS

| | | | | |
|---|---|---|---|---|
| 3,868,573 A | | 2/1975 | Holcomb et al. | 325/16 |
| 4,070,553 A | * | 1/1978 | Hass | 381/301 |
| 4,539,700 A | | 9/1985 | Sato | 381/90 |
| 4,876,724 A | | 10/1989 | Suzuki | 381/187 |
| 5,148,002 A | | 9/1992 | Kuo et al. | 219/211 |
| 5,438,698 A | | 8/1995 | Burton et al. | 455/351 |
| 5,757,929 A | | 5/1998 | Wang et al. | 381/24 |
| 5,884,198 A | * | 3/1999 | Kese et al. | 455/575 |

FOREIGN PATENT DOCUMENTS

| | | |
|---|---|---|
| GB | 2305361 A | 9/1996 |
| WO | WO9608804 | 9/1995 |
| WO | WO9807239 | 8/1997 |

OTHER PUBLICATIONS

Extract From www.wearcam.org/historical /node 11 Fabric Cover for Conductors.

* cited by examiner

*Primary Examiner*—Suhan Ni

(57) ABSTRACT

A garment comprises a fabric shell (10) to which a number of electronic devices (12, 14) are removably attached, suitably in respective pockets (16,18). Linking the devices (12, 14) are a pair of electrical conductors (20, 22) with a fabric cover (24) over at least a part of their length. The fabric shell (10) and fabric cover (24) are provided with complementary connectors such as press-studs (26) to enable the fabric cover (24) and conductors (20, 22) to be attached to the garment, and easily removed therefrom for upgrades and/or cleaning of the garment.

12 Claims, 3 Drawing Sheets

GARMENT WITH REMOVABLE ELECTRONIC DEVICES

The present invention relates to wearable electronic devices and systems, and in particular to garments comprising a fabric shell to which a plurality of electronic devices are removably attached, with one or more electrical conductors being connectable to at least one of said devices and extending therefrom.

An example of a garment of the type recited in the opening paragraph is given in U.S. Pat. No. 5,148,002 (Kuo et al) which describes a multi-functional garment comprised of an outer shell garment and a number of detachable modules, including heating, communications and display devices. Interconnection of the modules is by direct cabling between them.

A further example of a garment of the type recited in the opening paragraph is given in U.S. Pat. No. 4,539,700 (Sato) which describes a personal portable audio device in the form of a garment having a number of pockets for receiving components of the system. A pair of speakers for reproduction of the audio are provided in the left and right shoulder portions of the garment, with the wiring from the audio signal source component to the speakers being hidden within the garment construction.

The Sato patent illustrates one means for responding to a problem of interconnection—namely the wearer of the garment becoming entangled in the wiring interconnecting the various modules or components. Hiding the interconnections within the fabric or construction of the garment itself can lead to further problems, however, in that the cabling or other interconnect media must be able to withstand repeated cleaning, whether dry cleaning or conventional laundry. Even in the case where the interconnection can withstand cleaning, incorporation within the garment makes it very difficult, if not impossible, to replace an interconnection that has become damaged or otherwise needs replacement.

It is accordingly an object of the present invention to provide a garment which addresses the problem of the user becoming tangled whilst at the same time making removal and/or replacement of interconnections relatively simple.

In accordance with the present invention, there is provided a garment comprising a fabric shell to which a plurality of electronic devices are removably attached, with one or more electrical conductors being connectable to at least one of said devices and extending therefrom;

wherein said conductors are provided, over at least a part of their length, with a fabric cover, and said fabric shell and fabric cover are provided with complementary connectors to enable said fabric cover and conductors to be removably attached to said garment.

The fabric cover, which may include electrical shielding material, acts as a retainer for the cabling to hold it to the garment body such as to reduce the chance of user entanglement, whilst still permitting detachment to facilitate removal and/or replacement. To further aid this, the fabric cover may be openable to permit the removal or replacement of one or more of the conductors: in such an arrangement, the fabric cover may be provided with further complementary connectors to enable re-closure following removal or replacement of one or more of said conductors.

Various connector devices and mechanisms may be used to provide the complementary connectors including, but not limited to, buttons and buttonholes, press studs or poppers, zip fasteners, and Velcro™.

The fabric cover may carry cable terminating at one end in a pair of earphones (or headphones) for replaying audio to a wearer of the garment, with the fabric cover being so shaped, and the complementary connectors so positioned, that the said one end is attached to a collar portion of the garment. With the cover and its contents being easily removable from the garment, the user is enabled to upgrade or simply replace such earphones or headphones without damaging the garment.

Further features of the present invention are defined in the attached claims, to which reference should now be made, and the disclosure of which is incorporated herein by reference.

Embodiments of the invention will now be described by way of example with reference to the accompanying drawings in which:

FIG. 1 schematically represents a garment holding a pair of connected electrical devices;

Figure 1:
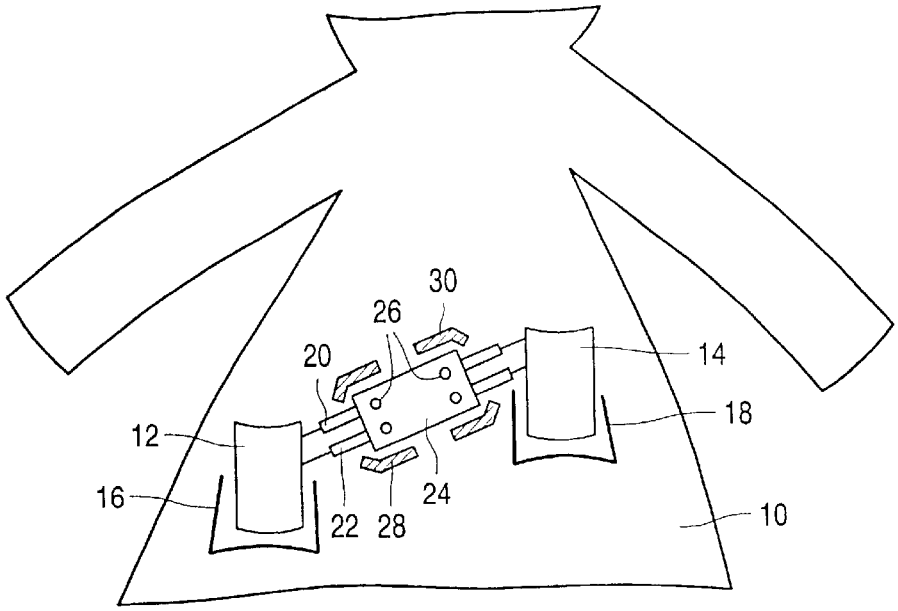

Beginning with the schematic representation of FIG. 1, a garment is represented comprising a fabric shell 10 to which a number of electronic devices 12, 14 are removably attached. Whilst shown in the general form of a jacket or upper body garment, it will be readily understood from reading of the following how the present invention is not limited to any particular garment type or style.

The electronic devices 12, 14 to be linked are suitably located on the garment in respective pockets 16,18, each featuring appropriate means for establishing connection to the device received. Linking the devices 12, 14 am a pair of electrical conductors 20, 22 with a fabric cover 24 over at least a part of their length. The fabric shell 10 and fabric cover 24 are provided with complementary connectors (two lines of press-studs 26 in this example) to enable the fabric cover 24 and conductors 20, 22 to be attached to the garment, and easily removed therefrom for upgrades and/or cleaning of the garment. As illustrated, the fabric shell 10 may carry markings 28, 30 to direct the user as to how the cover 24 is to be positioned.

Figure 2:
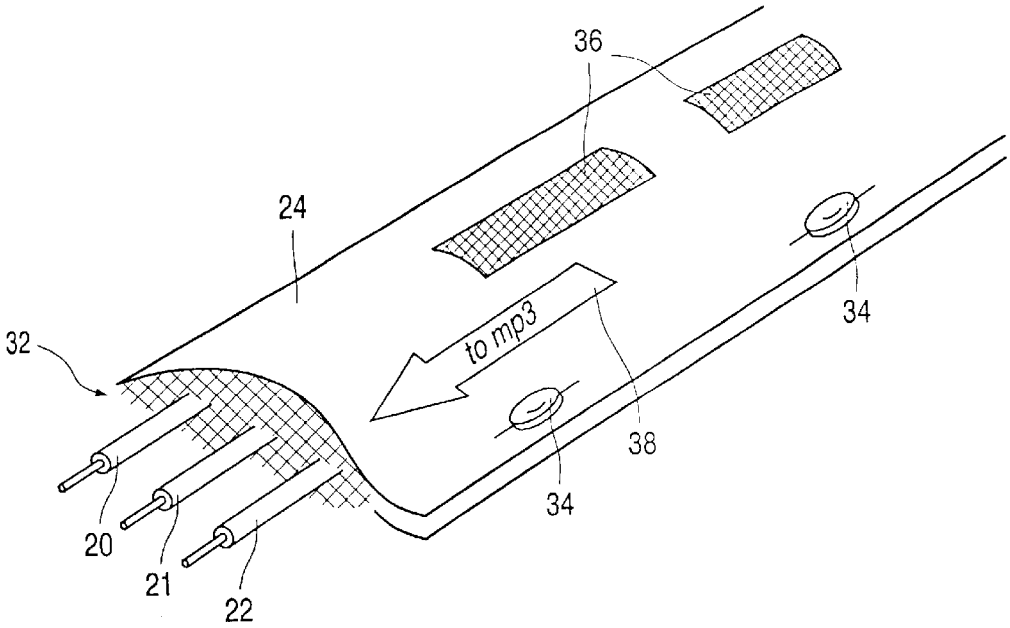
FIG. 2 shows a portion of interconnect cable with fabric covering as embodied by the invention.
Figure 3:
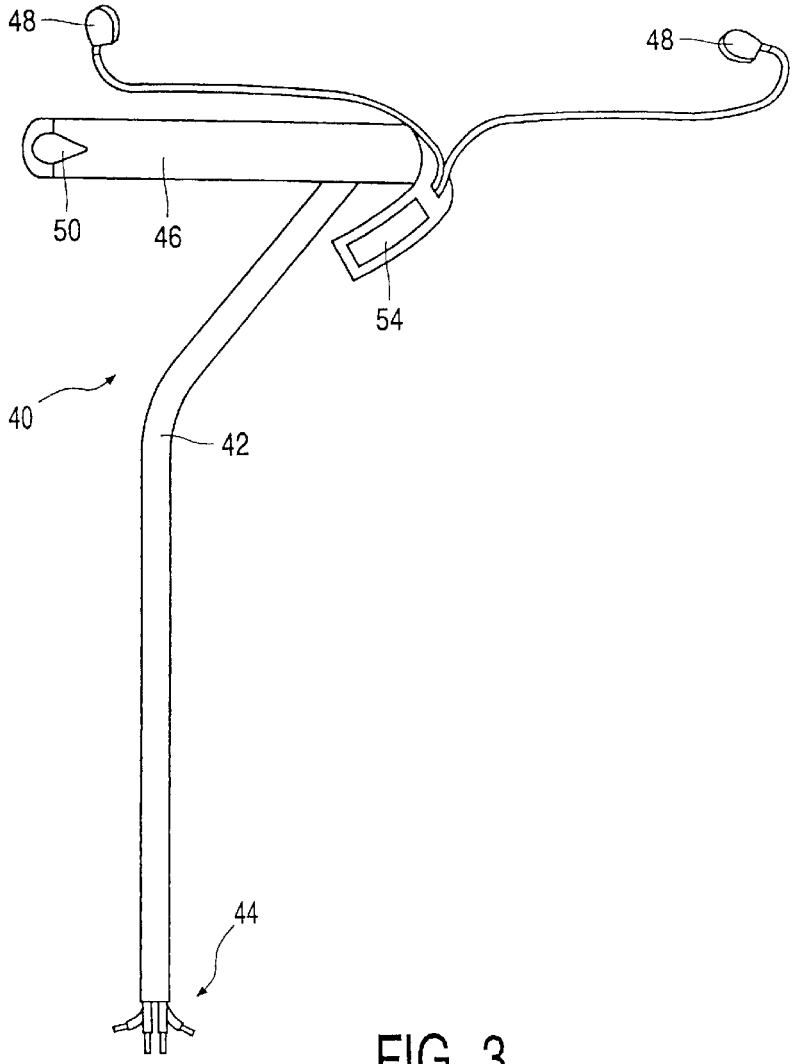
FIG. 3 shows an alternative configuration of interconnect cable to that of FIG. 2.

FIG. 2 shows a first embodiment of fabric covered interconnect cable, with three conductors 20, 21, 22 wrapped in a fabric cover 24. The material of the fabric cover 24 plays no specific part in the functionality of the interconnect cable, although considerations such as frequency of likely removal and replacement may dictate harder wearing materials such as leather, nylon, or other synthetics, whereas ease and comfort of wear may dictate finer materials such as cotton or silks. As shown, the interconnect cable may feature a layer of conductive material 32 to act as shielding around the cables 20–22 carried: in an alternative embodiment, the fabric cover 24 and conductive material layer 32 may be integral (e.g. with conductive threads woven into the fabric of the cover).

The cover 24 itself may be openable to enable a user to simply add, remove or replace one or more of the conductors 20–22, with further complementary connectors provided to enable the cover 24 to be re-closed: in this instance button holes and buttons 34 are used, although press-studs, zips, Velcro™ or other options may instead be provided. These connectors may additionally play a role in the securing of the cover 24 to the fabric shell 10, although in the example shown, separate patches of Velcro™ 36 are provided for this purpose.

As an alternative, or addition, to the markings 28, 30 (FIG. 1) on the garment fabric shell, the fabric cover 24 may carry markings 38 to direct the user how the cover and interconnect cabling is to be fitted.

A further embodiment of fabric covered interconnect cable 40 is shown in FIGS. 3 to 6. Here the fabric cover is generally T-shaped, with an elongate lower portion 42 carrying a number of cable connections 44 to a portable telephone and/or other audio apparatus. A cross portion 46 of the cover carries the cabling on, terminating at one end in a pair of earphones 48 (or headphones in the alternate) emerging from the cover at or near one end of the cross portion 46 and for replaying audio to a wearer of the garment. At or near the other end of the cross portion 46, a further cable or cables terminate in a microphone 50 attached to the cross portion.

Figure 4:
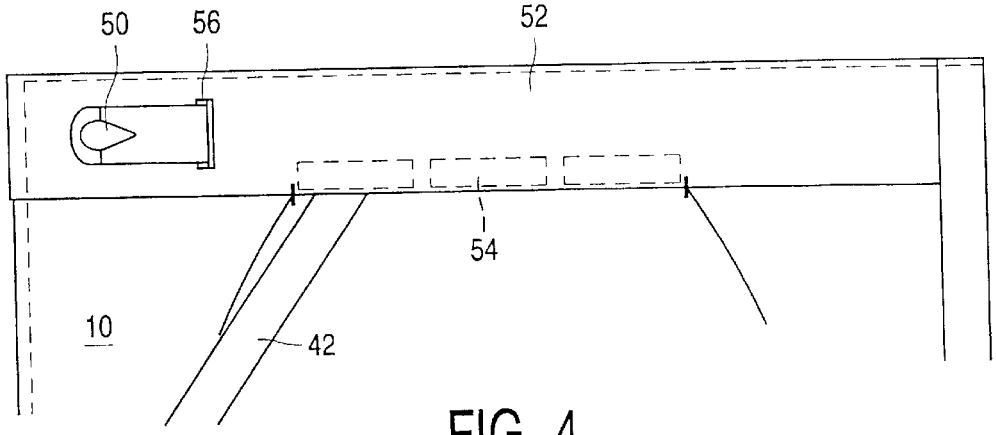
FIG. 4 illustrates, in opened out arrangement, the interconnect cable of FIG. 3 in position in the collar of a garment.

In use, the interconnect cable 40 carries the earphones 48 and microphone in the collar 52 of a garment fabric shell 10, as shown laid out flat in FIG. 4. The collar 52 suitably comprises a fold over portion to cover the cross piece 46, with the patches of Velcro™ 54 being used to hold the cross portion 46 in place, and with an aperture 56 in the collar 52 to allow the microphone 50 to protrude through.

Figure 5:
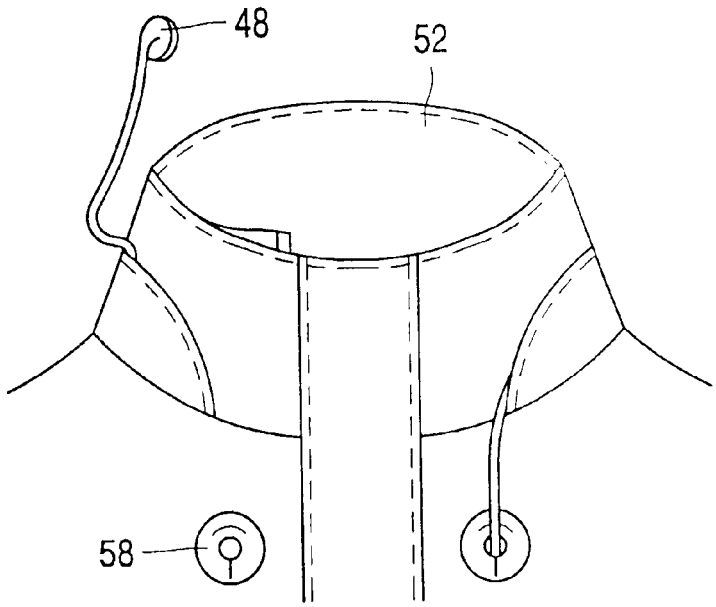
FIG. 5 is a front view of the garment collar of FIG. 4 in wearable orientation.
Figure 6:
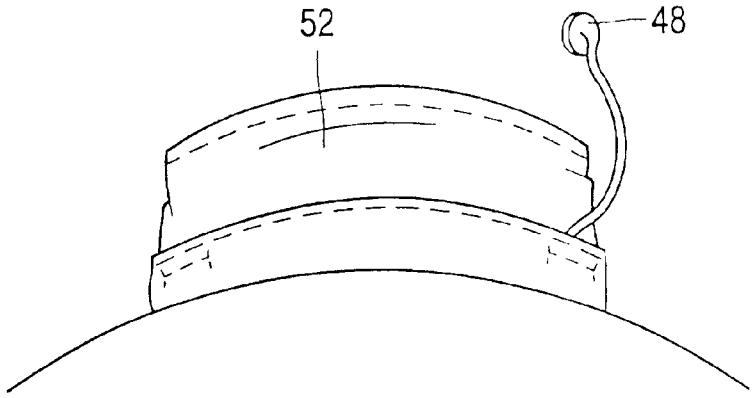
FIG. 6 is a rear view of the garment collar of FIG. 5.

The collar 52 is shown in "wearable" form in FIGS. 5 and 6 in front and back views respectively. As can be seen, the earphones 48 emerge discretely from the collar 52 close to the users ears such that there is a minimum of loose cable for the user to become entangled with—either within or outside the garment. To further reduce likelihood of tangling, the garment preferably also features retaining clips or holders 58 into which the earphones may simply be clipped to prevent them swinging about when not in use.

From reading the present disclosure, other modifications will be apparent to persons skilled in the art. Such modifications may involve other features which are already known in the design, manufacture and use of garments and applications and devices for incorporation therein and which may be used instead of or in addition to features already described herein.

What is claimed is:

1. A garment comprising a fabric shell to which a plurality of electronic devices are removably attached, with one or more electrical conductors being connectable to at least one of said devices and extending therefrom;

wherein said conductors are provided, over at least a part of their length, with a fabric cover, and said fabric shell and fabric cover are provided with complementary connectors to enable said fabric cover and conductors to be removably attached to said garment.

2. A garment as claimed in claim 1, wherein the fabric cover includes electrical shielding material.

3. A garment as claimed in claim 1, wherein the fabric cover is openable to permit the removal or replacement of one or more of said conductors.

4. A garment as claimed in claim 3, wherein the fabric cover is provided with further complementary connectors to enable re-closure following removal or replacement of one or more of said conductors.

5. A garment as claimed in claim 1, wherein the complementary connectors comprise press studs.

6. A garment as claimed in claim 1, wherein the complementary connectors comprise patches of Velcro™.

7. A garment as claimed in any of claim 1, wherein the complementary connectors comprise buttons and buttonholes.

8. A garment as claimed in claim 1, wherein the fabric cover carries cable terminating at one end in a pair of earphones for replaying audio to a wearer of the garment, with the fabric cover being so shaped, and the complementary connectors so positioned, that said one end is attached to a collar portion of the garment.

9. A garment as claimed in claim 8, further comprising retaining clips or holders configured to be capable of holding said earphones when not in use.

10. A garment as claimed in claim 8, wherein the fabric cover further carries cable terminating at one end in a microphone, said microphone being attached to the fabric cover at or close to said one end attached to a collar portion of the garment.

11. A garment as claimed in claim 1, wherein the fabric cover carries external markings indicating to a user how it should be attached to said garment.

12. A garment as claimed in claim 1, wherein the fabric shell carries markings indicating to a user how the fabric cover should be attached to said garment.

* * * * *